US005681406A

United States Patent [19]

Kim et al.

[11] Patent Number: 5,681,406

[45] Date of Patent: Oct. 28, 1997

[54] MANUFACTURING METHOD OF DELAYED HYDRIDE CRACKING RESISTANT SEAMLESS PRESSURE TUBE MADE OF ZIRCONIUM (ZR) ALLOY

[75] Inventors: Seong-Su Kim; Dae-Whan Kim; Joon-Wha Hong; Young-Whan Kang, all of Daejeon-Si, Rep. of Korea

[73] Assignee: Korea Atomic Energy Research Institute, Daejeon-Si, Rep. of Korea

[21] Appl. No.: 249,296

[22] Filed: May 25, 1994

[30] Foreign Application Priority Data

Sep. 15, 1993 [KR] Rep. of Korea ..... 93-18523

[51] Int. Cl.[6] ..... C22C 16/00

[52] U.S. Cl. ..... 148/672; 148/421

[58] Field of Search ..... 148/672, DIG. 3, 148/421, DIG. 14; 420/422

[56] References Cited

U.S. PATENT DOCUMENTS

| | | | |
|---|---|---|---|
| 4,065,328 | 12/1977 | Cheadle | 148/12.7 B |
| 4,094,706 | 6/1978 | Schulson et al. | 148/11.5 F |
| 4,226,647 | 10/1980 | Schulson et al. | 148/32.5 |
| 4,452,648 | 6/1984 | Cheadle et al. | 148/11.5 F |
| 5,223,055 | 6/1993 | Charquet et al. | 148/672 |

*Primary Examiner*—Charles Nold
*Attorney, Agent, or Firm*—Armstrong,Westerman,Hattori,McLeland & Naughton

[57] ABSTRACT

A method for manufacturing a delayed hydride cracking resistant zirconium ahoy (Zircaloy-2, Zircaloy-4, Zr-2.5% Nb, pure Zr, etc.) pressure tube includes the steps of making a seamless pressure tube having a diameter smaller than the final size by extrusion or drawing, and then expanding the tube at a temperature below 600° C. by cross rolling.

6 Claims, 9 Drawing Sheets

<11$\bar{2}$2> TWIN SIDE SHAPE

<11$\bar{2}$1> TWIN SIDE SHAPE

<10$\bar{1}$2> TWIN SIDE SHAPE

BEFORE DEFORMATION

NORMAL DIRECTION ROLLING

DEFORMATION AMOUNT: 30%

CROSS-ROLLING

DEFORMATION AMOUNT: 30%

MANUFACTURING METHOD OF DELAYED HYDRIDE CRACKING RESISTANT SEAMLESS PRESSURE TUBE MADE OF ZIRCONIUM (ZR) ALLOY

FIELD OF THE INVENTION

The present invention relates to a method for manufacturing zirconium alloy seamless pressure tube which is used for a CANDU reactor, and which has a texture having an improved fracture toughness and having a resistance against the crack propagation due to the delayed hydride cracking (to be called DHC below) mechanism (the texture indicates the structure in which a C-axis of a hexagonal close packed structure is concentrated in the direction of the diameter of the seamless pressure tube, i.e., the structure in which crystalline grains having c and d orientation the seamless pressure tube of FIG. 2 are profuse).

BACKGROUND OF THE INVENTION

In the conventional manufacturing method for the seamless pressure tube for the CANDU nuclear reactor, a billet having a hole is made to undergo a hot extrusion, and then, a cold drawing is carried out, thereby forming a zirconium alloy (Zircaloy-2, Zr-2.5% Nb or the like) seamless pressure tube. However, the zirconium alloy seamless pressure tube has a special texture which is formed during the manufacturing process, and which is a micro-structure in which the orientation of the crystalline grains within the material is preponderantly distributed in a particular direction. Therefore, it is very susceptible to the delayed hydride cracking, and therefore, it is liable to be damaged during reactor operation of the reactor.

When the cause of the damage of the pressure tube was investigated, it was found that the delayed hydride cracking was the most serious factor for impeding the safety. Around the year 1980, studies were made on the mechanism of the delayed hydride cracking, the influence of the texture on the delayed hydride cracking, and the formation of the texture in the material of the pressure tube.

For example, C. E. Coleman and S. Sagat of the Canadian Nuclear Power Corporation (Canada AECL-CRL) manufactured the existing Zr-2.5% Nb alloy plate in a different orientation, and, investigated into the influence of the texture on the delayed hydride cracking. Consequently, they confirmed that the texture gives a great influence to the delayed hydride cracking.

R. A. Holt et al performed an experiment by adjusting the extrusion ratio during the manufacturing process, thereby making a study on the influence of the extrusion ratio on the alteration of the texture of the material of the pressure tube. Consequently, they could confirm that the extrusion ratio does not give any influence to the texture of the pressure tube. In Korea, Kim Sung-Soo et all used a Zr-2.5% Nb plate to make a study on the influence of the texture on the delayed hydride cracking. Consequently they confirmed that the resistance against the delayed hydride cracking can be improved through the variation of the texture.

Thus there have been carried out studies on the influence of the texture on the delayed hydride cracking in Canada in Korea. Consequently, a conclusion has been derived that the texture of seamless pressure tube made of zirconium alloy has to be modified in order to improve DEC resistance. However, there has not been developed a method which can modify the texture of seamless pressure tube through modification of the fabrication process.

SUMMARY OF THE INVENTION

The present invention is intended to overcome the disadvantages of the conventional technique described above.

Therefore it is the object of the present invention to provide a zirconium alloy seamless pressure tube in which the texture of the zirconium alloy seamless pressure tube is modified in order to improve the reactor safety and the operation rate of CANDU reactor.

In order to vary the texture which is formed in the zirconium alloy seamless pressure tube which is manufactured by a hot extrusion process, the extrusion and drawing are not used in varying the seamless pressure tube, but a cross rolling or an other method for expanding a tube under a planar deformation condition is used, thereby improving the texture of the final seamless pressure tube product.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

The delayed hydride cracking resistant zirconium (Zr) alloy seamless pressure tube according to the present invention is manufactured by applying a cross rolling on an extruded zirconium alloy (such as Zircaloy-2, Zircaloy-4, Zr-2.5% Nb, Zr-1% Nb, pure Zr or the like) so as to expand the tube, thereby raising the basal pole component in the radial direction of the tube.

The method for manufacturing the zirconium alloy (Zircaloy-2, Zircaloy-4, Zr-2.5% Nb, pure Zr etc.) according to the present invention includes the steps of: making a seamless pressure tube having a diameter smaller than the final size by applying a high temperature extrusion expanding the tube at a temperature below 600° C. without causing a significant phase transformation and without causing a deformation of the deforming mechanism; and applying a tube expansion method such as a rotary rolling, a rotary piercing or the like so as to expand the tube through a cross rolling during the process, and so as to improve the texture of the seamless pressure tube.

Further, during the tube expansion process, a pressure (hydraulic pressure or explosion) is applied, thereby improving the texture of the seamless pressure tube. Of the above methods for expanding the tube, at least two methods or more are applied so as to improve the texture of the seamless pressure tube. Further, one or more tube expanding methods, an intermediate annealing and a drawing are applied to improve the texture of the seamless pressure tube.

Figure 1:
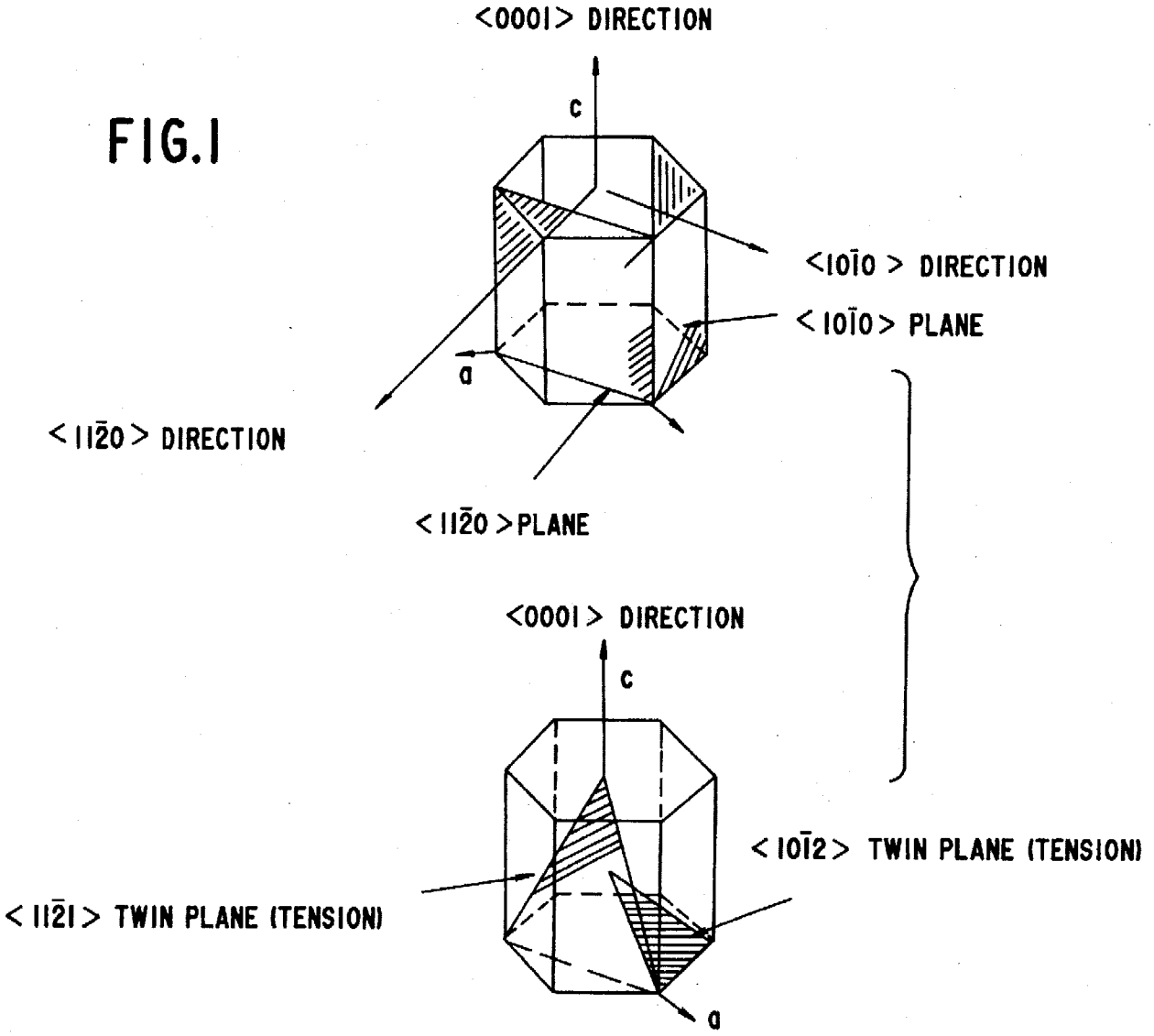
FIG. 1 illustrates a C-axis and twin crystal planes in a hexagonal close packed structure.
Figure 2:
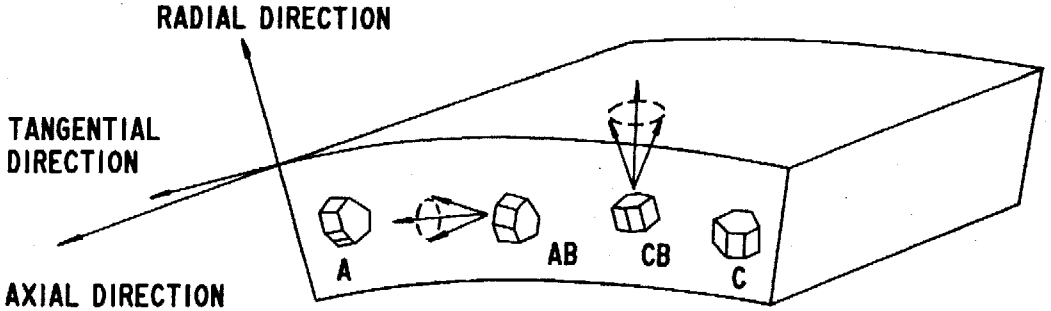
FIG. 2 illustrates the orientation the crystalline grains within the material of the pressure tube.
Figure 3A:
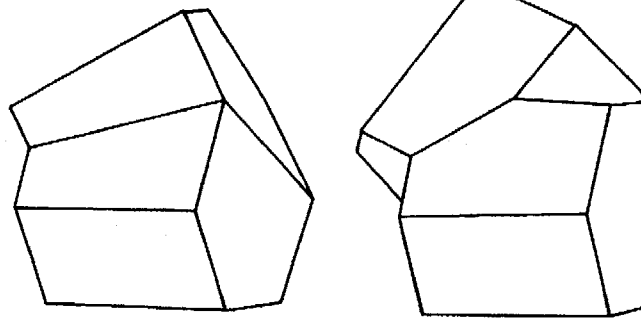
FIG. 3 illustrates the variation of a hexagonal close packed structure by varying twin planes.
Figure 3B:
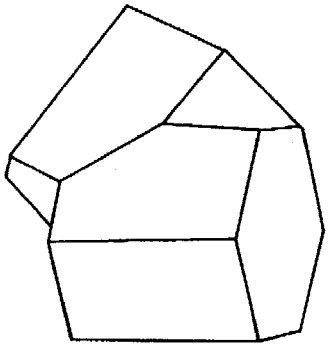
Figure 3C:
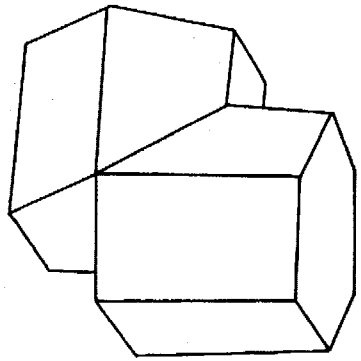
Figures 4, 4A:
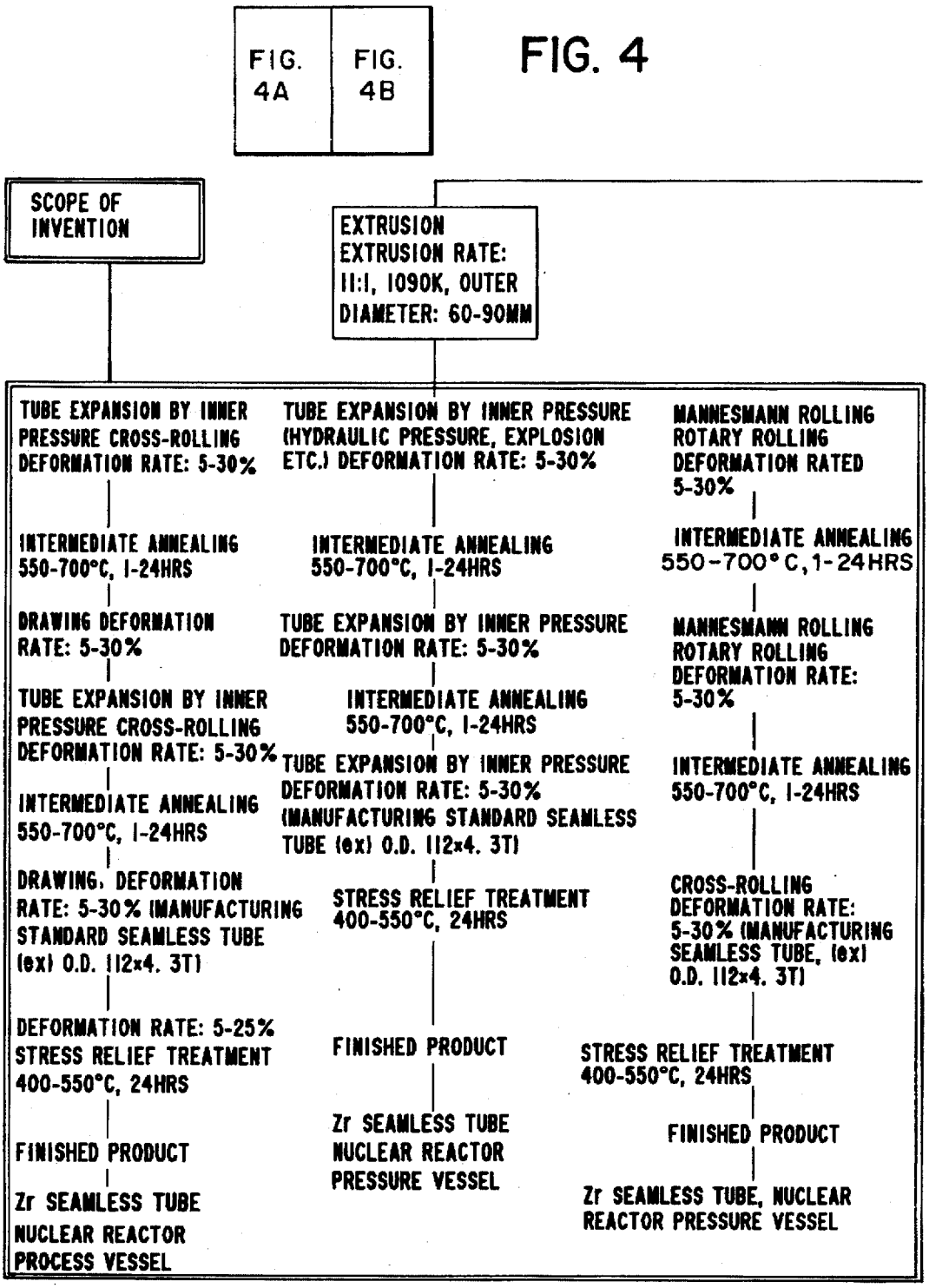
FIGS. 4, 4A and 4 B illustrate a comparison of the manufacturing processes.
Figure 4B:
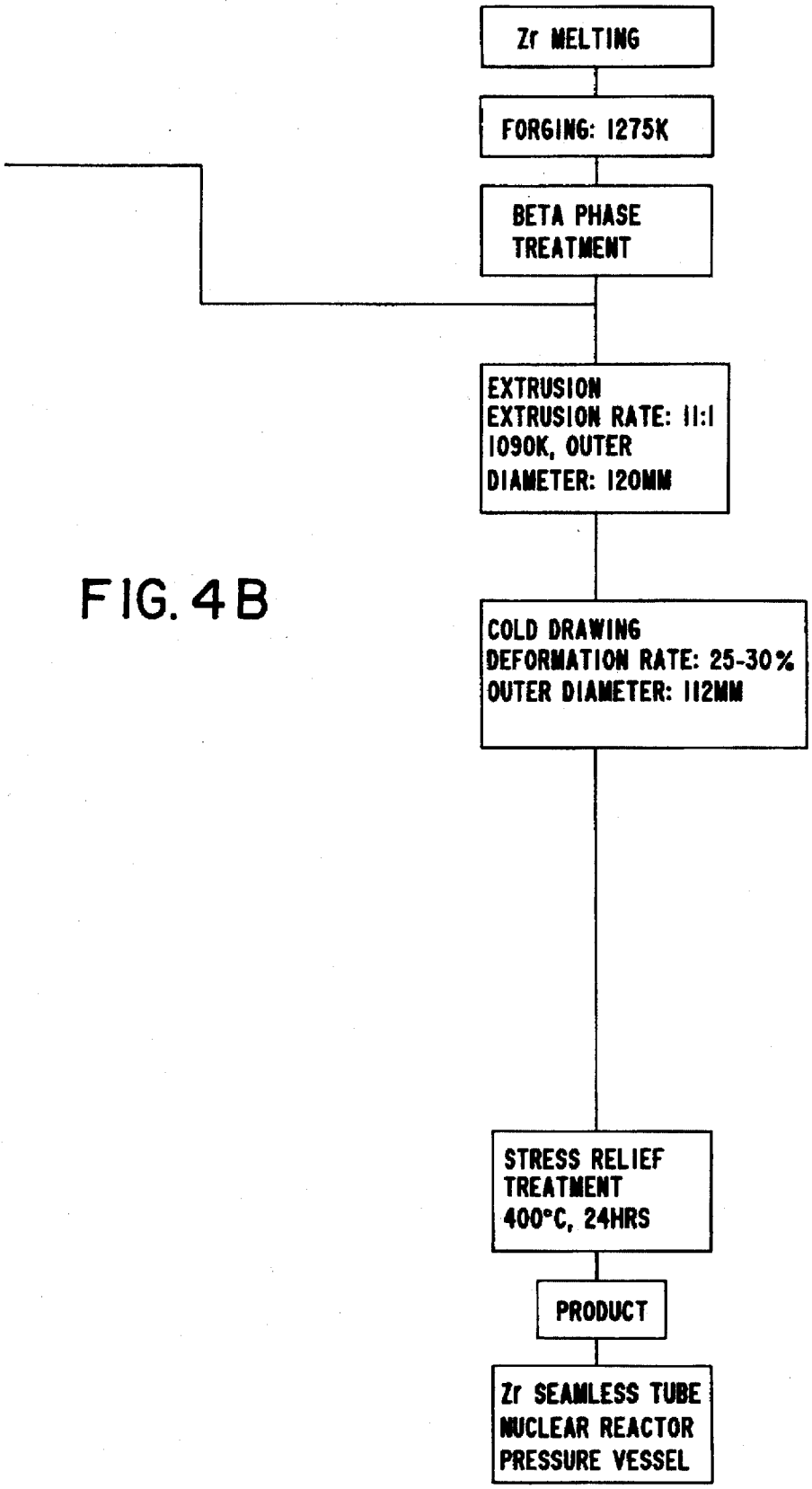
Figure 5A:
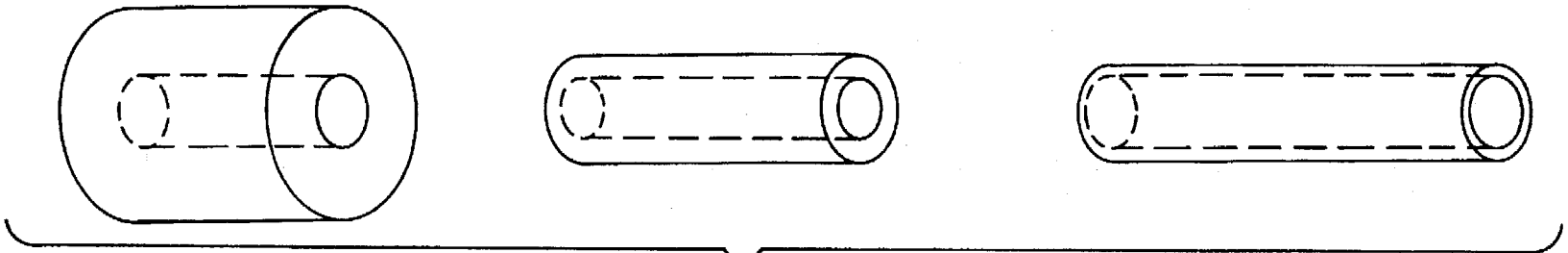
FIG. 5 illustrates a comparison of the manufacturing processes of the pressure tube having an improved texture.
Figure 5B:
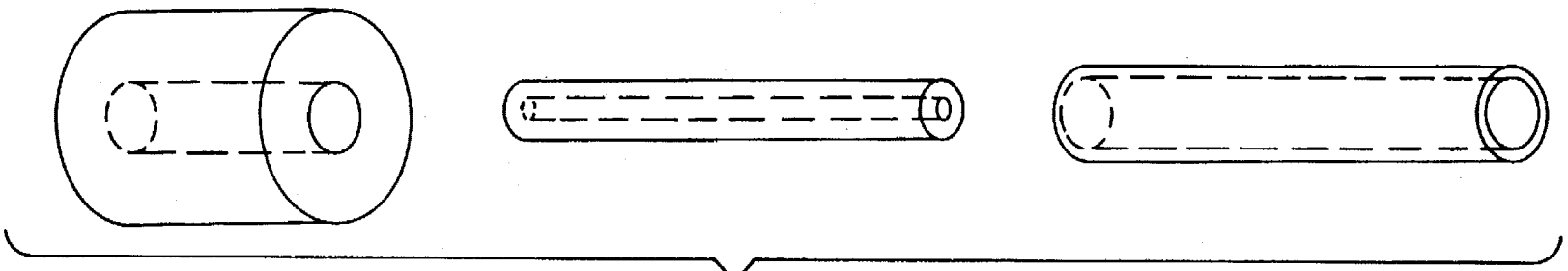
Figure 6A:
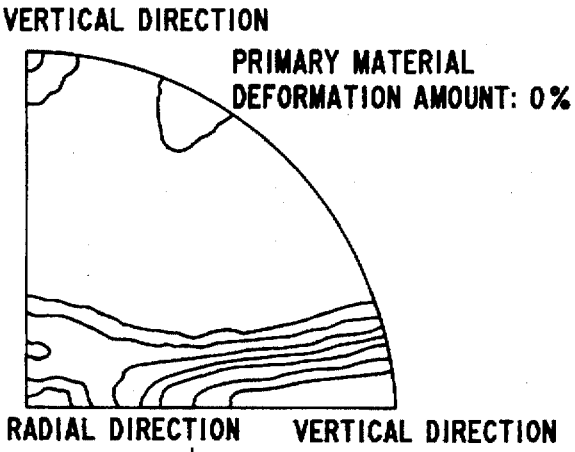
FIG. 6 illustrates the direct pole figures showing the variation of the texture owing to the direct rolling and the cross rolling.
Figure 6D:
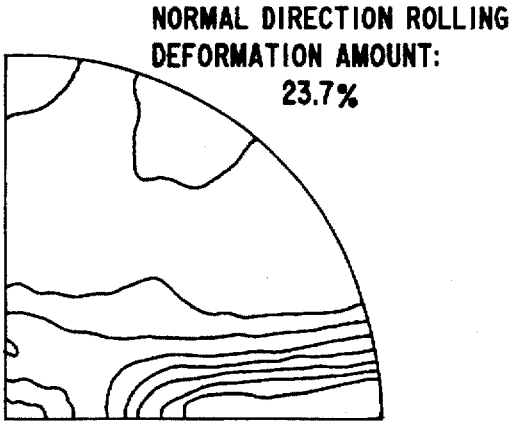
Figure 6B:
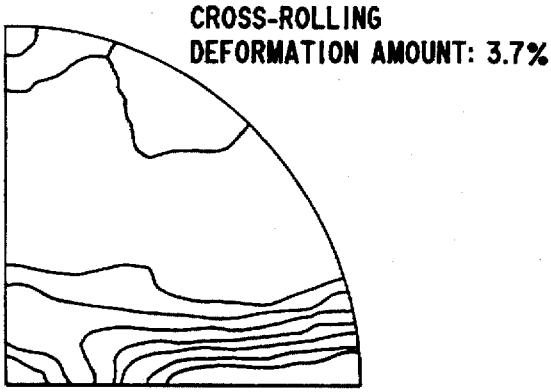
Figure 6E:
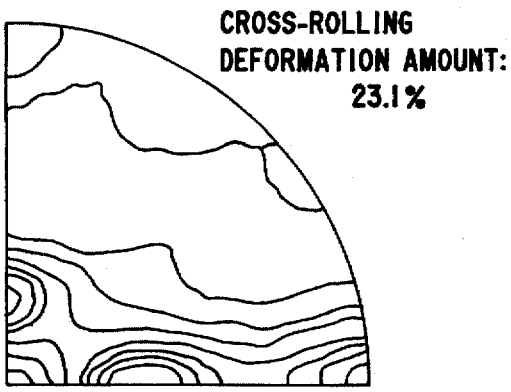
Figure 6C:
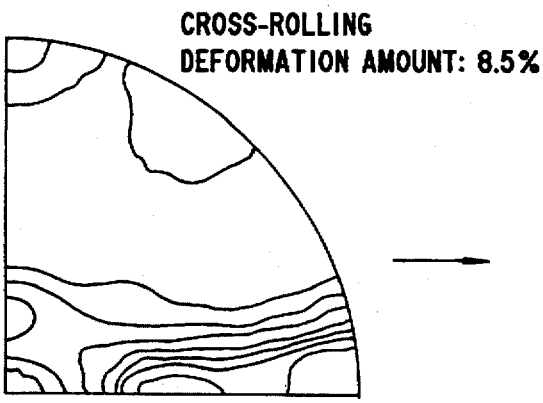
Figure 6F:
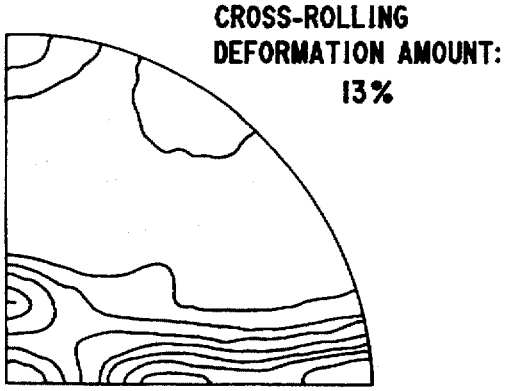
Figure 7A:
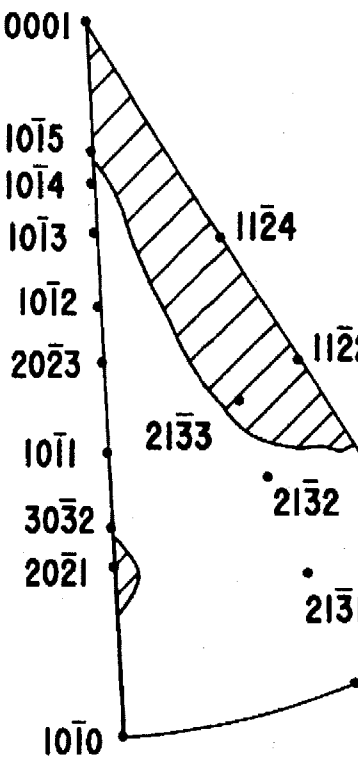
FIG. 7 illustrates inverse pole figures showing the texture formed by carrying out the direct rolling and the cross rolling in the plate used for confirming the improvement of the DHC resistance.
Figure 7B:
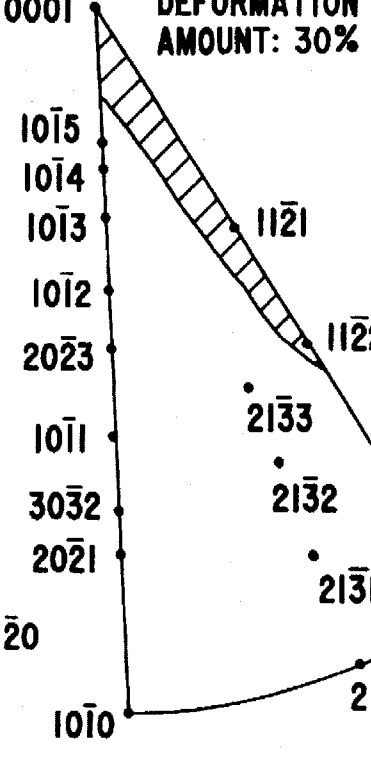
Figure 7C:
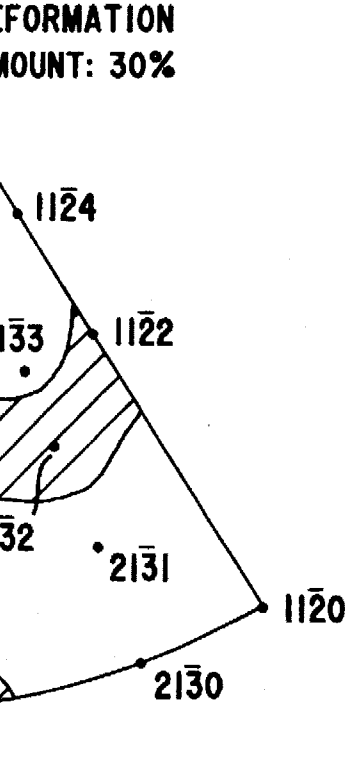

In other words, a hot extruded seamless pressure tube having a smaller diameter and a thicker wall thickness than the final product is expanded by applying a cross rolling method such as a rotary rolling (if the tube is expanded in planar expanding method in the orientation a and b of FIG. 2, the wall thickness becomes thinner). Thus $(10\bar{1}2)<\bar{1}011>$ and $(11\bar{2}1)<\bar{1}\bar{1}26>$ twin plane deformation is made to occur within the material of the hexagonal cross packed structure, so that a slip mechanism should act on the deformed crystal grains. Thus the C-axes of the crystal grains are made to be preponderantly distributed to the radial direction of the tube (the d and c directions in FIG. 2). FIG. 1 illustrates the twin crystal planes which act on the hexagonal close packed structure in the deformation mechanism. FIG. 3 illustrates the shape of the twin plane deformation. FIG. 4 is a flow diagram showing a comparison of the conventional manufacturing process with the manufacturing process according to the present invention. FIG. 5 schematically illustrates the process of manufacturing the pressure tube from a billet.

According to a modified embodiment of the present invention, the phase constituting the greater part of Zircaloy-2, Zircaloy-4, Zr-2.5% Nb, Zr-1% Nb and the pure zirconium is an α-Zr of the hexagonal close packed structure. The problems of the texture of these alloys are related to the concentration of the basal pole components of the hexagonal close packed structure. Therefore, in these alloys, the sensitivity to the delayed hydride cracking is common, and the present invention improves the resistance of these alloys against the delayed hydride cracking.

In the process of expanding the seamless pressure tube (the crystal grains having a and b orientation in which the c axes of the crystal grain are concentrated, there appears a variation of the texture. This phenomenon improves the resistance against the DHC crack propagation. Therefore, even the tube expansion under a planar deformation condition can improve the texture.

Further, the proportions of the crystal grains having the c and d orientation of FIG. 2 can be increased by increasing the deformation amount during the cross rolling.

Figure 8B:
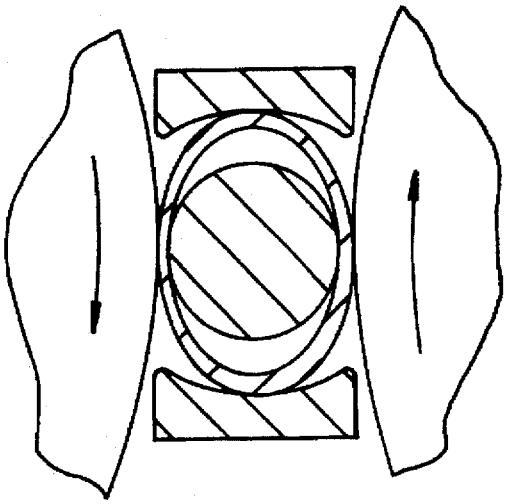
FIG. 8 is a schematic view of the rotary rolling.
Figure 8A:
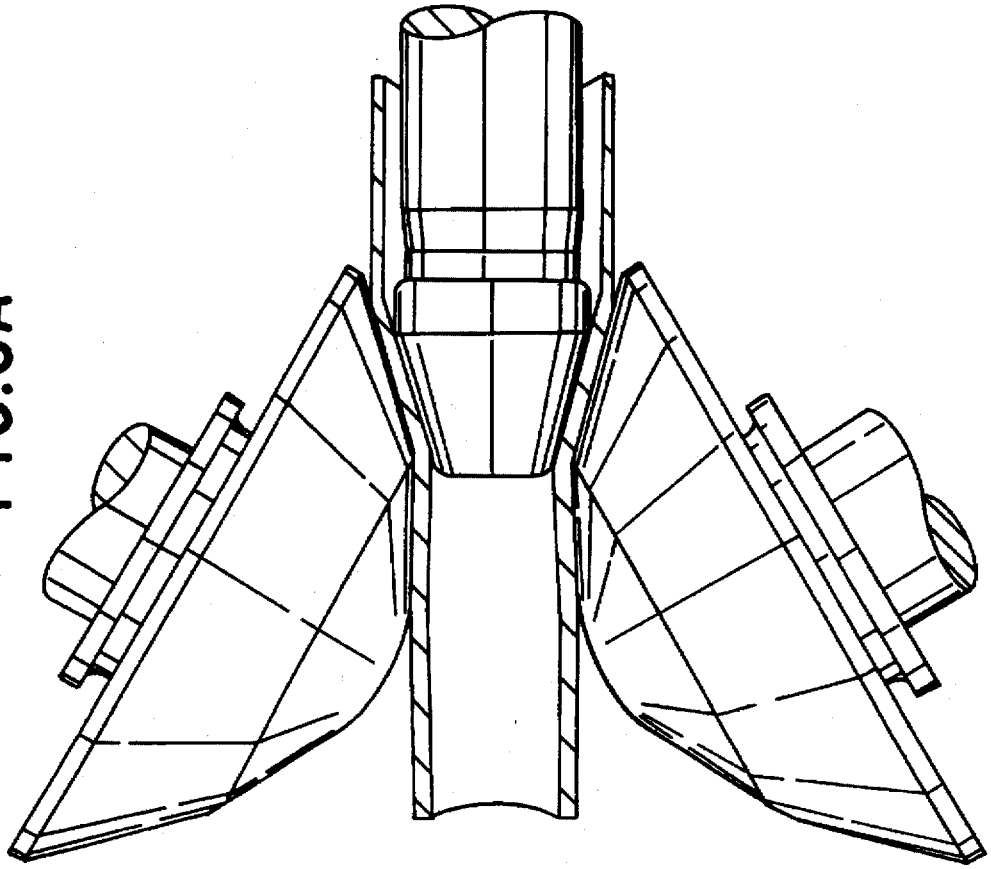
Figure 9:
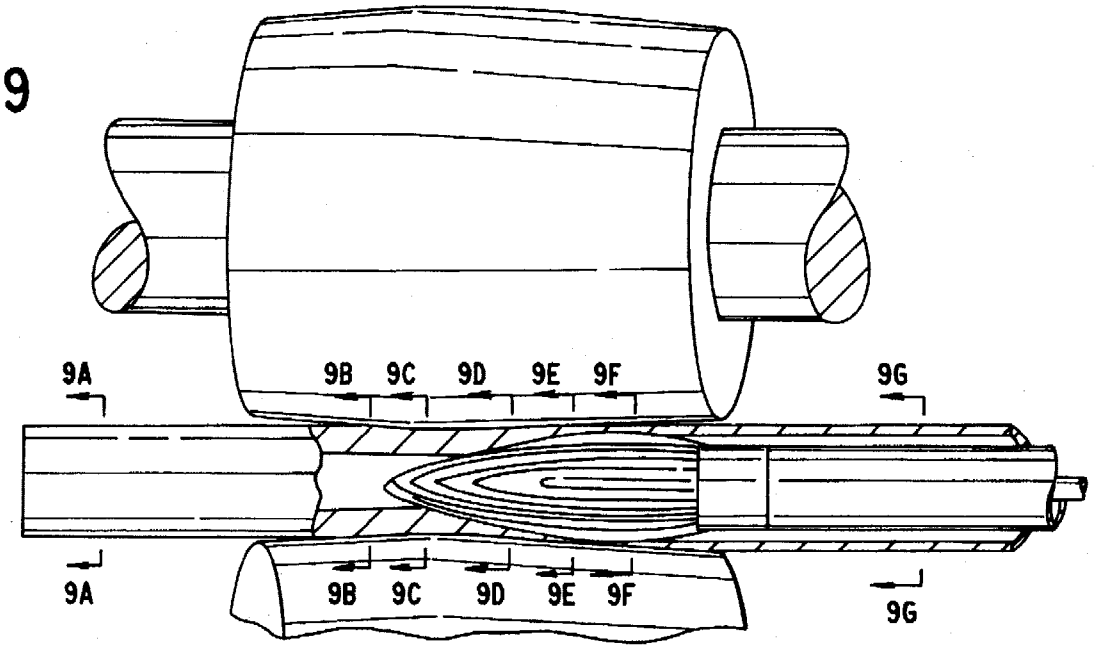
FIGS. 9, 9A–9G illustrate a schematic view of a rotary piercing mill.
Figure 9G:
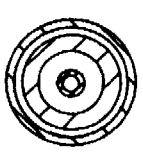
Figure 9F:
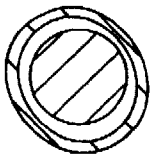
Figure 9E:
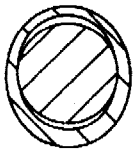
Figure 9D:
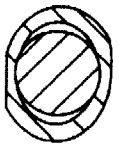
Figure 9C:
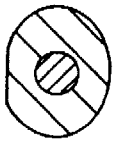
Figure 9B:
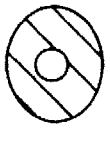
Figure 9A:
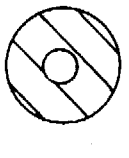

Therefore, the texture of the seamless pressure tube can be improved by applying a cross rolling by means of the rotary piercing mill of FIG. 9 which can fabricate through a planar deformation similarly to the rotary rolling mill of FIG. 8.

Further, a tube expanding method through explosion or hydraulic pressure can be carried out within a casing of a limited size, thereby improving the texture of the seamless pressure tube. For the explosion method, gas, explosive and electro-magnetic force can be utilized, while, for the hydraulic pressure, water, silicon oil and other hydraulic fluid can be used.

FIG. 4 illustrates several fabrication examples, and tube expansion and drawing can be combined to improve the texture. When the intermediate annealing is applied to eliminate work hardening effect during the processing at a temperature below the recrystallization level, the processing deformation amount is increased.

As an actual example, an annealed plate which has a texture similar to that of the pressure tube was subjected to a 30% cold rolling in the initial rolling direction like when the cold drawing (with the deformation amount being 25–30%) is applied to the pressure tube. Consequently, there was obtained a plate having the texture of the conventional seamless pressure tube.

Further, the above described annealed plate was subjected to a 30% cold rolling in the direction perpendicular to the initial rolling direction, with the result that there was obtained a texture which was similar to that of the seamless pressure tube of the present invention.

These two plates were used to form a subsize CT specimen (W=17 mm, t=3.3 mm), and then, was hydrogenized. Then the test piece was stress-relieved at a temperature of 367° C., and subjected to a hydrogen homogenization. Then tests were carried out such as a DHC crack propagation rate measuring test, a critical stress intensity factor measuring test, and a cracking factor measuring test. FIG. 6 illustrates the variation of the texture of the plates, and Table 1 shows the variation of the basal pole component. When the deformation amount of the cross rolling is 30%, the basal pole component of the plates in the transverse direction is as shown in Table 2.

The crack propagation speed due to the delayed hydride cracking mechanism was lowered to one half by the improvement of the texture as shown in Table 3. The critical stress expansion factor which is required for causing the delayed hydride cracking through the improvement of the texture rose to a double as shown in Table 4.

TABLE 1

Variation of basal pole component versus cold rolling amount

| Condition | Deformation rate (%) | Basal pole component FN* | FT* | FL* |
|---|---|---|---|---|
| As received | 0 | 0.31 | 0.63 | 0.06 |
| Direct rolled | 23.7 | 0.30 | 0.52 | 0.10 |
| Cross rolled | 3.7 | 0.3 | 0.6 | 0.1 |
| | 8.4 | 0.32 | 0.57 | 0.11 |
| | 13.0 | 0.37 | 0.52 | 0.11 |
| | 23.1 | 0.47 | 0.39 | 0.14 |

*FN: Radial direction of the tube or the perpendicular direction to the plate.
FT: Transverse direction of the plate or circumferential direction of the tube.
FL: Basal pole component in the lengthwise direction of the tube or the rolling direction of the plate.
FN + FT + FL = 1

TABLE 2

Basal pole component of the plates subjected to test for crack propagation speed caused by delayed hydride cracking mechanism.

| Condition | Deformation rate (%) | Basal pole component FN* | FT* | FL* |
|---|---|---|---|---|
| As received | 0 | 0.42 | 0.60 | 0.04 |
| Direct rolled (existing) | 30 | 0.41 | 0.53 | 0.06 |
| Cross rolled (improved) | 30 | 0.54 | 0.39 | 0.07 |

*: Same as Table 1.

TABLE 3

Comparison of delayed hydride cracking propagation speeds for different rolling methods

| Condition | DHC propagating speeds for diffrnt temp (m/sec) | | |
|---|---|---|---|
| | 170° C. | 200° C. | 230° C. |
| Direct rolled (existing) | $1.1 \times 10^{-8}$ | $2.3 \times 10^{-8}$ | $4.2 \times 10^{-8}$ |
| Cross rolled (improved) | $5.0 \times 10^{-9}$ | $1.1 \times 10^{-8}$ | $2.0 \times 10^{-8}$ |

TABLE 4

Variation of critical stress expansion factor through improvement of texture

| Condition | Critical stress expansion factor (MPa $\sqrt{m}$) |
|---|---|
| Existing texture | 4.5–6 |
| Improved texture | 11 |

What is claimed is:

1. A method for manufacturing a delayed hydride cracking resistant zirconium alloy seamless pressure tube, comprising the steps of:

making a seamless pressure tube having a diameter smaller than the final size by applying at least one of a high temperature extrusion and drawing; and expanding the tube at a temperature below 600° C. with a deforming fixture without causing a deformation of the deforming fixture so as to expand the tube through a cross rolling during the process.

2. The method as claimed in claim 1, wherein, during the tube expansion process, a pressure resistance process is applied.

3. The method as claimed in any one of claims 1, and 2, wherein at least two or more tube expanding methods are applied.

4. The method as claimed in any one of claims 1, and 2, wherein one or more tube expanding methods, an intermediate annealing and a drawing are applied.

5. The method as claimed in claim 1, wherein the tube expansion method is selected from the group consisting of a rotary rolling and a rotary piercing.

6. The method as claimed in claim 2, wherein the pressure resistance process is one of hydraulic pressure or explosion.

* * * * *

UNITED STATES PATENT AND TRADEMARK OFFICE

CERTIFICATE OF CORRECTION

PATENT NO.: 5,681,406
ISSUED : October 28, 1997
INVENTOR(S): Sung-Soo KIM et al.

It is certified that error appears in the above-identified patent and that said Letters Patent is hereby corrected as shown below:

TITLE PAGE:

Item [75], change "Seong-Su KIM" to --Sung-Soo KIM--;
change "Joon-Wha HONG" to --Jun-Hwa HONG--; and
change "Young-Whan KANG" to --Young-Hwan KANG--.

Signed and Sealed this

Seventh Day of July, 1998

Bruce Lehman

*Attest:*

BRUCE LEHMAN

*Attesting Officer*

*Commissioner of Patents and Trademarks*